US008028611B2

(12) United States Patent
Loundsbury

(10) Patent No.: US 8,028,611 B2
(45) **Date of Patent: *Oct. 4, 2011**

(54) GUN STABILIZER

(76) Inventor: Jonathan Charles Loundsbury, Essex, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/882,972

(22) Filed: Sep. 15, 2010

(65) Prior Publication Data

US 2011/0167692 A1 Jul. 14, 2011

Related U.S. Application Data

(63) Continuation of application No. 11/972,970, filed on Jan. 11, 2008, now Pat. No. 7,870,814.

(51) Int. Cl.
*F41A 21/00* (2006.01)

(52) U.S. Cl. ..... 89/14.05; 89/14.3; 42/1.06; 42/97

(58) Field of Classification Search ..... 89/14.05, 89/14.3, 198; 42/1.06, 97
See application file for complete search history.

(56) References Cited

U.S. PATENT DOCUMENTS

| | | | | | |
|---|---|---|---|---|---|
| 2,679,192 | A | * | 5/1954 | Seeley et al. | 89/14.3 |
| 2,845,737 | A | * | 8/1958 | Hoyer | 42/1.06 |
| 3,165,972 | A | * | 1/1965 | Cumbo | 89/14.05 |
| 4,307,653 | A | * | 12/1981 | Goes et al. | 89/198 |
| 4,476,969 | A | * | 10/1984 | Dykema | 188/380 |
| 4,974,493 | A | * | 12/1990 | Yeffman | 89/198 |
| 5,113,745 | A | | 5/1992 | Allen | |
| 5,339,789 | A | * | 8/1994 | Heitz | 124/56 |
| 6,227,098 | B1 | * | 5/2001 | Mason | 89/193 |

* cited by examiner

*Primary Examiner* — Michelle Clement
(74) *Attorney, Agent, or Firm* — Day Pitney LLP

(57) ABSTRACT

A damping device is disclosed which dampens movement of a weapon on an axis which is parallel to a longitudinal axis of the weapon.

22 Claims, 4 Drawing Sheets

GUN STABILIZER

BACKGROUND OF THE RELATED ART

CONTINUITY

This application claims priority to U.S. application Ser. No. 11/972,970, filed on Jan. 11, 2008, the entire disclosure of which is incorporated herein by reference.

The government (state and federal) would greatly benefit from a system which would help stabilize a gun in an unstable environment. Such an unstable environment exists where, for example, a government agent targets from an airborne helicopter a potential felon on the ground.

SUMMARY OF THE INVENTION

A damping device is disclosed which dampens movement of a weapon on an axis which is parallel to a longitudinal axis of the weapon. For example, as applied to a gun, the gun has three axises of motion, including the pitch, yaw and longitudinal axises, where the longitudinal axis is parallel to the gun barrel. The damping device allows motion in the longitudinal axis but prevents motion in the pitch and yaw axises.

BRIEF DESCRIPTION OF THE DRAWINGS

Illustrating the invention are attached figures in which.

DETAILED DESCRIPTION OF THE ILLUSTRATED EMBODIMENT

Figure 1:
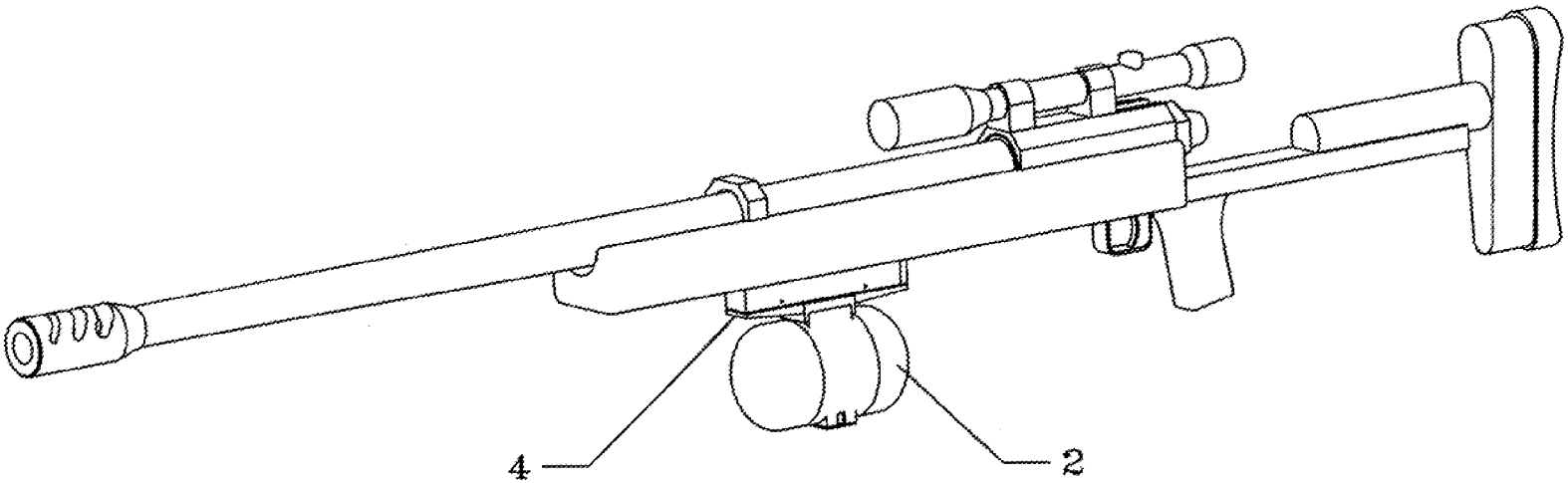
FIG. 1 is an illustration of a gun mounted with a stabilizer according to an embodiment of the invention.

Turning to FIG. 1 a gun 1 is illustrated of the type used in military operations. Such type of gun includes a single barrel riffle (as illustrated) or a single or multi-barrel machine gun such as a Gatling gun.

The gun 1 is fitted with a motion stabilizer 2. The stabilizer 2 illustrated is an Admiral KS-8 stabilizer, manufactured by Kenyon Laboratories LLC, 11 Scovil Rd., Higganum Conn. 06441. The diameter of the KS-8 is 3.4" and the KS-8 is 5.8" long along its longitudinal axis. It contains two gyroscopic wheels (not illustrated) which are disposed in opposing axises to each other. When the wheels are wound up to a normal 22000 RPM operating speed, the stabilizer resists both pitch and yaw relative to its longitudinal axis.

Figure 2:
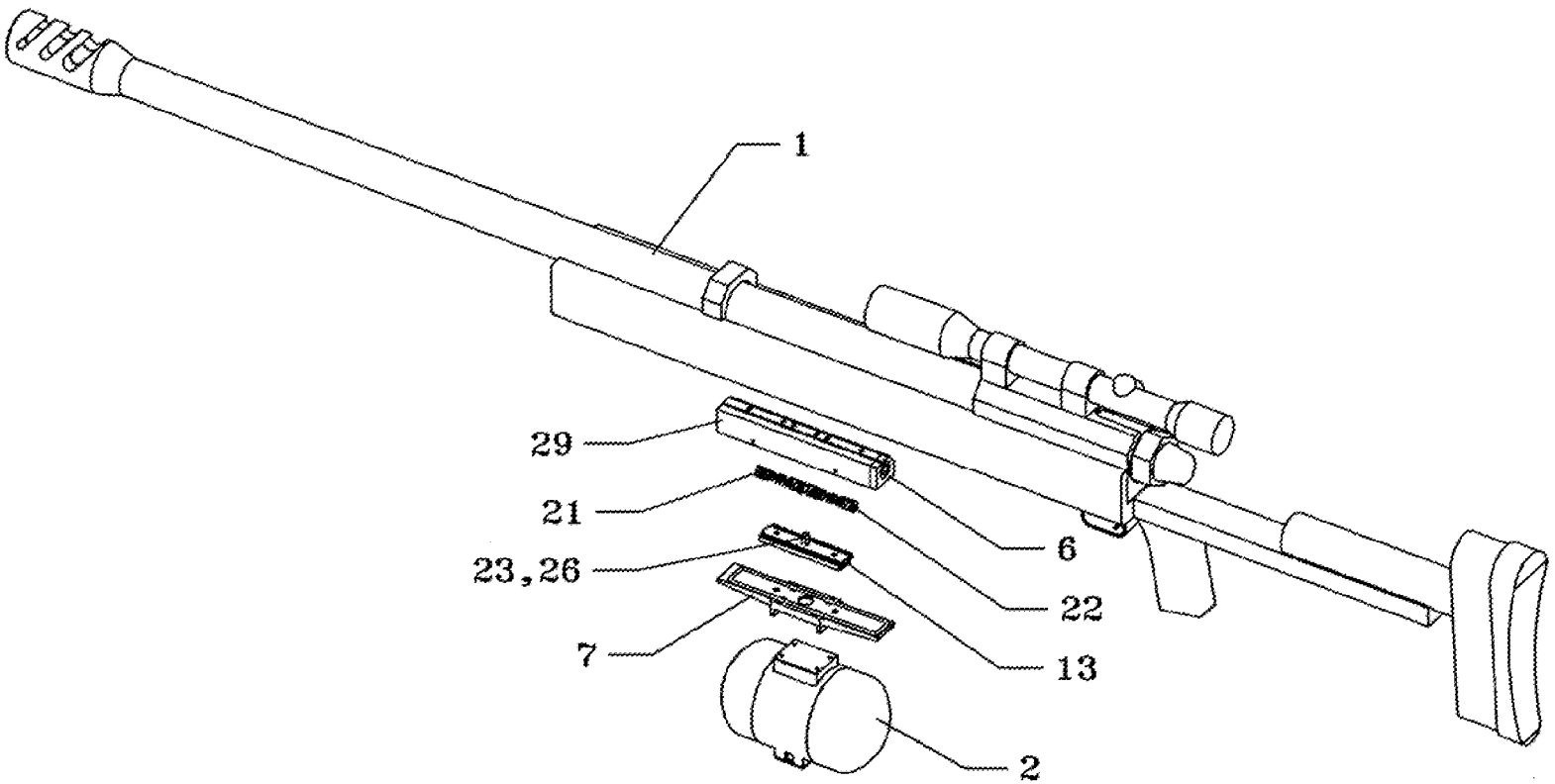
FIG. 2 is an exploded view of the embodiment illustrated in FIG. 1.
Figure 3:
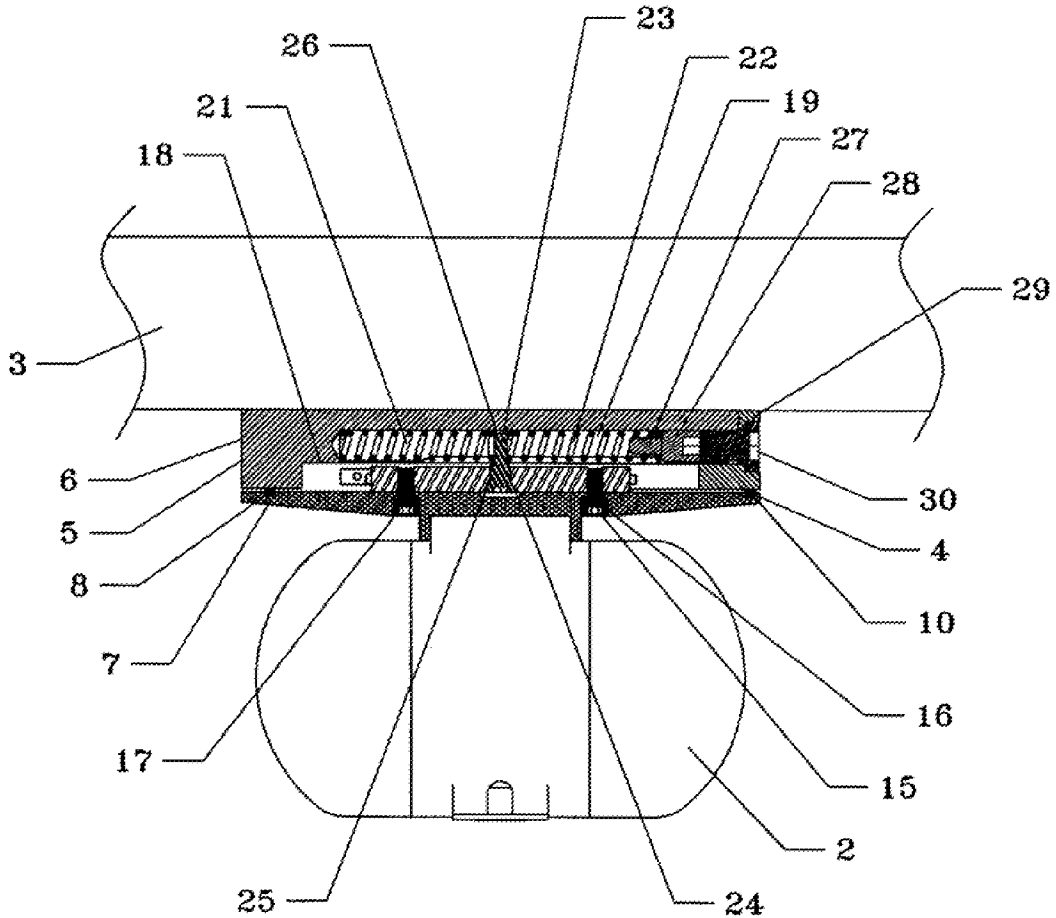
FIG. 3 is a cross sectional view of the embodiment illustrated in FIG. 1.

Turning to FIGS. 2 and 3, the stabilizer 2 is connected to a forearm/barrel 3 of the gun 1 by a recoil damping means 4. The recoil damping means 4 contains an outer casing 5. The outer casing 5 contains a top member 6 and a bottom member 7. The outer casing 5 is fabricated from aluminum.

The outer casing 5 and gun barrel 3 are connected via a NATO STANdardized AGreements (NATO STANAG) Rail mounting system (not shown). One example is model A.R.M.S. 17, by Atlantic Research Marketing Systems, Inc., 230 West Center Street, West Bridgewater, Mass. 02379. A.R.M.S. 17 has been adopted as the Military Standard MIL-STD-1913, which is a United States Defense Standard, aka, a "MIL-SPEC", where official definitions for military standards are provided by DOD 4120.24-M Defense Standardization Program (DSP) Policies and Procedures, March 2000, OUSD.

Alternatively, the casing for the recoil damping means can be attached or fabricated as a part of the gun stock or gun barrel.

A sealing means 8 is provided between the top member 6 and the bottom member 7 of the outer casing 5. The sealing means prevents foreign matter from contaminating the internal components (discussed below) of the recoil damping means 4.

The sealing means 8 includes an o-ring, such as a frictionless Buena O-ring. The bottom member 7 of the outer casing 5 contains an elongated oval grove 11 shaped to receive the seal 8. The seal 8 is placed in the grove 11 of the bottom member 7 and pressed between the bottom member 7 and top member 6 of the outer casing 5 in a customary fashion when the recoil damping means 4 is assembled.

Figure 4:
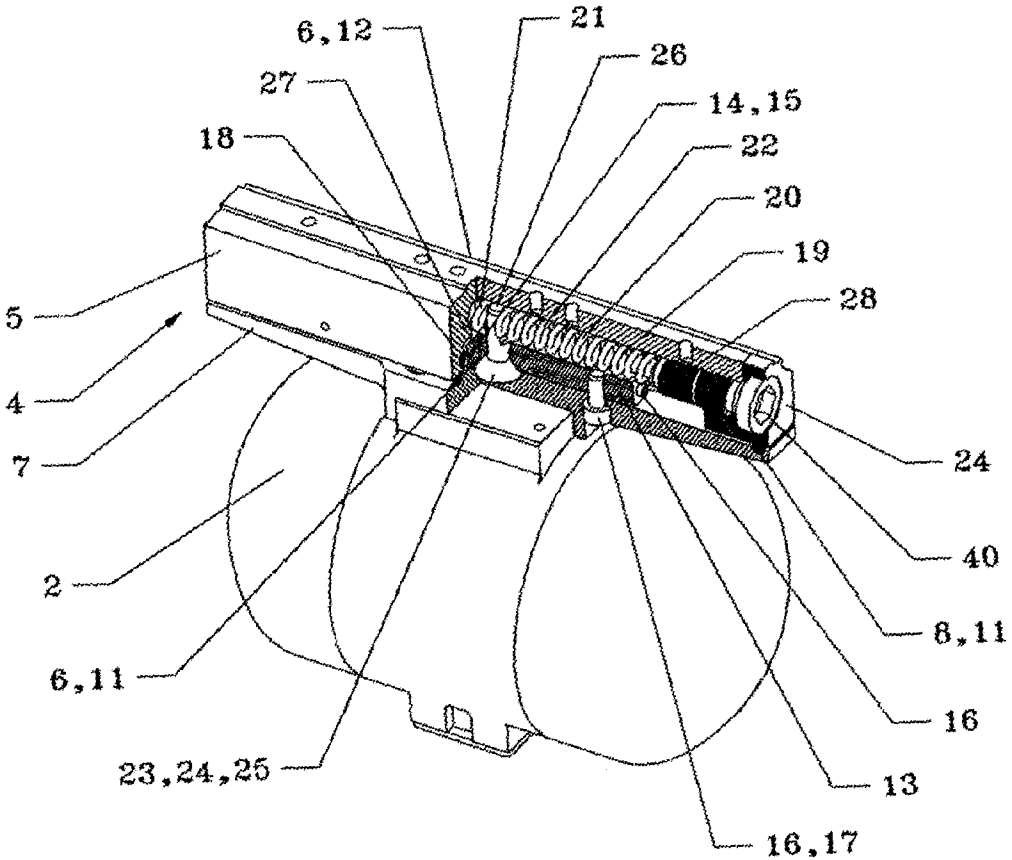
FIG. 4 is an isometric, cross-sectional view of the embodiment illustrated in FIG. 1.

As further illustrated in FIG. 4, the top and bottom members 6 and 7 of the outer casing 5 are connected by sliding means 12. The purpose of the sliding means 12 is to allow the stabilizer 2 to move in the longitudinal direction of the gun barrel 3. Such motion, enabled by structure disclosed below, is required to dampen induced shock forces from gun recoil. Left undamped, the shock forces transfer unbounded to the gyroscopic wheels within the stabilizer. In such an instance, spinning at 22000 RPM, the wheels become catastrophically unstable. This instability translates into the destruction of the stabilizer and potentially anything in the path of thereafter uncontained and uncontrolled wheels.

The sliding means 12 includes a cross-roller bearing slide. The illustrated cross slide is a Crossed-Roller Bearing Slide 2" Stroke Length, 220# Dynamic Load Cap, obtained from the McMaster Can Supply Company, listed as item number 6257K28. The McMaster Can Supply Company is located at 600 N County Line Rd., Elmhurst, IL 60126-2081, with a mailing address of P.O. Box 4355, Chicago, Ill. 60680-4355.

The bearing slide 12 includes a sliding base member 13. The slide base member 13 is manufactured from lightweight, corrosion-resistant aluminum with a black anodized finish. The slide base member 13 includes rails and rollers 14 and 15 which are hardened steel and the base 13 further includes stainless steel end caps 16. The slide base member 13 essentially unmodified as compared to the purchased bearing slide item number 6257K28 except as provided below.

The slide base member 13 is disposed against the bottom member of the outer casing 5 and secured thereto by slide base securing means 17. As illustrated in FIG. 3, the slide base securing means includes two counter-bored holes 16 and 17. The holes are adapted for receiving #6 socket head cap screws.

Instead of utilizing the slide carriage provided with the purchased bearing slide, the inventive system utilizes the top member 6 of the outer casing 5 as the carriage. Machined in the top member 6 is a first cavity 18 which forms the carriage of the slide bearing and mates with the slide base member 13. The length of the first cavity 18 provides the desired range of longitudinal motion for the slide base member 13. The cross section of the first cavity 18 is essentially that of the slide carriage provided with the purchased bearing slide. Accordingly, the combination of the first cavity 18 and the slide base 13 provides a structure which corresponds to the purchased bearing slide.

A second cavity 19 is provided in the top member 6 of the outer casing 5. Disposed therein are damping means 20 for damping the recoil forces transmitted to the stabilizer 2. The damping means 20 enables the stabilizer to travel around an initial rest point, discussed below. As s result of the underdamped motion of the stabilizer, the stabilizer 2 is minimally perturbed by gun recoil and receives minimal transmission of the recoil forces.

The damping means 20 includes first and second heavy springs 21 and 22. Heavy springs are known to have characteristics of both springs and inertial dampers. The springs are Raymond die springs, part number 105-110, obtained from MSC Industrial Direct Co., Inc., having a corporate headquarters at 75 Maxess Road, Melville, N.Y. 11747-3151. The corresponding part number at MSC Industrial Direct Co., Inc. is part number 07662323. The springs have the following characteristics: Die Springs Load Type: Heavy-Duty Rod Diameter: 3/16 Hole Diameter: 3/8 Type; Die Spring Maximum Deflection: 0.75 In. Material; Chromium Alloy Steel Free Length: 2½.

Disposed between axially opposing ends of the springs 21 and 22 is a means 23 for communicating damping motion from the springs to the slide base 13. The means 23 includes a machined bolt 24 whose head 25 is screwed into a counterbored hole in the slide base 13. The opposing axial end 26 of the bolt 24 is formed into a pin extending into the second cavity 19 of the top member 6 of the outer casing 5, as illustrated, when the recoil damping means 4 is assembled.

For receiving the pin 26, the second cavity 19 is equipped with a slot 27. The slot is wide enough to allow friction free motion of the pin 26 along the slot and long enough to allow for the desired longitudinal travel of the slide base 13.

A compression bolt 28 is utilized for providing an initial compression of the springs 21 and 22. For example, the springs are initially compressed about three-quarters (¾) of an inch to an inch for rigidly holding the structure of the recoil damping means in place and prevents free movement of the stabilizer 2 during normal use. It will be appreciated that the initially compressed and unperturbed location at which the opposing ends of the springs 21 and 22 meet defines the above mentioned initial rest point for the pin 26.

An end cap 29 and securing bolt 30 are provided. When secured to the outer casing 5, the recoil damping means 4 is secured and sealed.

It is to be appreciated that before the compression bolt 28 and end cap 29 are secured, the springs 21 and 22 and the slide base 13 can be slid out of the recoil damping means 4 by the openings in the rear end 31 of the top portion 6 of the outer casing 5. Assembly of the components is merely the reverse operation.

As assembled, the crisscrossed cylindrical roller design of the bearing slide system lets the recoil damping means 4 handle forces in the longitudinal direction. Accordingly, the recoil damping means, with the locked motion in the pitch and yaw axises from the stabilizer and the dampened movement in the longitudinal axis from the springs 21, is appropriate for high-speed application and shock conditions such as those found in the application of the invention.

Moreover, as an additional benefit, the mass of the stabilizer, as connected to the gun via the recoil damping means, absorbs a portion of the rearward longitudinal movement of the gun upon firing. It has been demonstrated that the recoil forces upon a person's body are significantly diminished even with the stabilizer in an inactive state. This is from the mass of the stabilizer tending to remain stationary upon the firing of the gun and the springs acting against the motion of the recoil which would otherwise be transferred directly to the person. In this use of the invention, for purposes of absorbing recoil forces, the stabilizer can be replaced with a solid mass—of course, the stabilizing affect would not be realized when replacing the stabilizer 2 with a solid mass.

What has been disclosed herein is a damping device which dampens movement of a weapon on an axis which is parallel to the gun barrel.

The above discussion is merely an illustration of an embodiment of the invention and does not serve to limit the scope of the invention.

I claim:

1. A stabilizer system for a weapon, the weapon capable of launching a projectile along a longitudinal axis of the weapon, the stabilizer system comprising:

a motion stabilizer having at least one gyroscopic element; and a recoil damper connecting the motion stabilizer to the weapon so that the spin axis for the at least one gyroscopic element is disposed substantially along the longitudinal axis of the weapon;

said recoil damper configured for moving the motion stabilizer substantially only along the longitudinal axis of the weapon;

whereby motion in the pitch and yaw axises relative to the longitudinal axis of the weapon is prevented and recoil forces to the motion stabilizer are dampened.

2. The system of claim 1 wherein the recoil damper has a longitudinal axis disposed parallel to the longitudinal axis of the weapon and the recoil damper dampens forces relative to its longitudinal axis.

3. The system of claim 1 wherein the weapon is a gun and the recoil damper is connected to the forearm or barrel of the gun.

4. The system of claim 2, wherein the recoil damper has one or more springs for dampening forces relative to its longitudinal axis.

5. The system of claim 3 wherein the recoil damper includes an outer casing, the outer casing being:

removably connected to the gun; or fabricated as a part of the gun stock or gun barrel.

6. The system of claim 5 wherein the outer casing of the recoil damper includes a first member connected to the gun and a second member connected to the motion stabilizer, the first member being movably connected to the second member.

7. The system of claim 6 wherein the first member of the recoil damper is movably connected to the second member via a slide.

8. The system of claim 7 wherein the slide includes:

a cross-roller bearing slide base member;

a cavity forming a carriage for receiving the slide base member disposed in one of the first and second members of the outer casing; and the slide base member fixedly connected to the other of the first and second members of the outer casing.

9. The system of claim 7 wherein an internal damper is provided in the recoil damper, the internal damper communicating with the slide for damping recoil forces transmittable from the gun to the stabilizer.

10. The system of claim 9 wherein the internal damper biases the longitudinal motion of the stabilizer about an initial rest point.

11. The system of claim 9 wherein the internal damper includes:

springs disposed in a second cavity, the second cavity disposed in the one of the first and second members of the outer casing; and means, connected to the slide base, for communicating damping motion from the springs to the slide base.

12. The system of claim 11 wherein the means for communicating damping motion from the springs to the slide base includes a bolt having one end fixedly connected to the slide base and an opposite end disposed against the springs and biasable by the springs.

13. The system of claim 11 wherein the springs are provided with an initial compression for preventing free movement of the stabilizer.

14. The system of claim 6 wherein a seal is disposed between the first and second members of the recoil damper.

15. The system of claim 14 wherein the seal is an o-ring.

16. The system of claim 1 wherein the recoil damper includes a first member connected to the weapon and a second member connected to the motion stabilizer, the first member being slidably connected to the second member.

17. The system of claim 16, wherein one of the first and second members includes axially aligned springs and another of the first and second members continually contacts axially adjacent spring ends, so that the axially adjacent spring ends translate during recoil.

18. The system of claim 16, where the first member is removably connected or integral with the weapon and the second member is removably connected or integral with the motion stabilizer.

19. The system of claim 17, wherein the another of the first and second members continually contacts the axially adjacent spring ends via a bolt.

20. The system of claim 1, wherein the at least one gyroscopic element is at least one gyroscopic wheel.

21. The system of claim 20 wherein the at least one gyroscopic wheel in the motion stabilizer includes at least one pair of gyroscopic wheels adapted for spinning at a predetermined rotational speed whereby the stabilizer resists both pitch and yaw relative to its longitudinal axis.

22. The system of claim 1, wherein:

the recoil damper connects the motion stabilizer to the weapon so that the spin axis for the at least one gyroscopic element is disposed substantially parallel with the longitudinal axis of the weapon; and said recoil damper configured for moving the motion stabilizer, relative to the weapon, substantially only parallel with the longitudinal axis of the weapon.

* * * * *

UNITED STATES PATENT AND TRADEMARK OFFICE

CERTIFICATE OF CORRECTION

PATENT NO. : 8,028,611 B2
APPLICATION NO. : 12/882972
DATED : October 4, 2011
INVENTOR(S) : Jonathan Charles Lounsbury It is certified that error appears in the above-identified patent and that said Letters Patent is hereby corrected as shown below:

Title page, Item (76) Inventor: please replace "Jonathan Charles Loundsbury" with --Jonathan Charles Lounsbury--.

Title page, Item (76) Inventor: please replace "Essex, NY (US)" with --Essex, CT (US)--.

Signed and Sealed this
Twenty-ninth Day of November, 2011

David J. Kappos

David J. Kappos
*Director of the United States Patent and Trademark Office*